US010497323B2

(12) United States Patent
Zhou et al.

(10) Patent No.: US 10,497,323 B2
(45) Date of Patent: Dec. 3, 2019

(54) PIXEL CIRCUIT, METHOD FOR DRIVING THE SAME, DISPLAY PANEL AND DISPLAY DEVICE

(71) Applicant: SHANGHAI TIANMA MICRO-ELECTRONICS CO., LTD., Shanghai (CN)

(72) Inventors: Xingyao Zhou, Shanghai (CN); Chuanli Leng, Shanghai (CN); Yuan Li, Shanghai (CN)

(73) Assignee: SHANGHAI TIANMA MICRO-ELECTRONICS CO., LTD., Shanghai (CN)

( * ) Notice: Subject to any disclaimer, the term of this patent is extended or adjusted under 35 U.S.C. 154(b) by 178 days.

(21) Appl. No.: 15/889,643

(22) Filed: Feb. 6, 2018

(65) Prior Publication Data

US 2018/0166025 A1 Jun. 14, 2018

(30) Foreign Application Priority Data

Aug. 21, 2017 (CN) ..... 2017 1 0717874

(51) Int. Cl.
*G09G 3/34* (2006.01)
*G09G 3/3208* (2016.01)

(52) U.S. Cl.
CPC ..... *G09G 3/3413* (2013.01); *G09G 3/3208* (2013.01); *G09G 2320/0233* (2013.01); *G09G 2320/0252* (2013.01)

(58) Field of Classification Search
CPC ..... G09G 3/3413; G09G 3/3208; G09G 2320/0233; G09G 2320/0252;
(Continued)

(56) References Cited

U.S. PATENT DOCUMENTS 9,595,227 B2 * 3/2017 Yang ..... G09G 3/3233
9,978,312 B2 * 5/2018 Yang ..... G06F 3/0416
(Continued)

FOREIGN PATENT DOCUMENTS

CN 102568374 A 7/2012
CN 104485071 A 4/2015
(Continued)

*Primary Examiner* — Chad M Dicke
(74) *Attorney, Agent, or Firm* — Alston & Bird LLP

(57) ABSTRACT

The disclosure discloses a pixel circuit, a method for driving the same, a display panel and a display device, which utilize a first initialization module, a data writing module, a threshold compensation module. Besides, since the pixel circuit is further provided with a second initialization module and the second initialization module is configured to enable a signal of a first voltage terminal to flow through the driving transistor before a light emitting device emits light, after the pixel circuit displays a low-grayscale image and before the pixel circuit displays a high-grayscale image, a large current is enabled to flow through the driving transistor to compensate for a threshold voltage hysteresis effect of the driving transistor, thereby improving the problem that the brightness of a first frame is low after an existing pixel circuit has switched from displaying a low-grayscale image to displaying a high-grayscale image.

12 Claims, 9 Drawing Sheets

(58) Field of Classification Search
CPC ..... G09G 3/3233; G09G 2320/045; G09G 2310/0216; G09G 2230/00
See application file for complete search history.

(56) References Cited

U.S. PATENT DOCUMENTS

| | | | | |
|---|---|---|---|---|
| 10,043,449 | B2 * | 8/2018 | Lee | G09G 3/3258 |
| 10,068,524 | B2 * | 9/2018 | Yang | G06F 3/0412 |
| 10,103,214 | B2 * | 10/2018 | Kim | G09G 3/3291 |
| 10,192,484 | B2 * | 1/2019 | Li | G09G 3/3233 |
| 2014/0118231 | A1 * | 5/2014 | Yang | G09G 3/3258 345/82 |
| 2014/0191669 | A1 * | 7/2014 | Tan | G09G 3/3233 315/172 |
| 2014/0225075 | A1 * | 8/2014 | Zhan | H01L 29/78672 257/40 |
| 2015/0054812 | A1 | 2/2015 | Jeon | |
| 2015/0262526 | A1 * | 9/2015 | Park | G09G 3/3233 345/76 |
| 2015/0294618 | A1 * | 10/2015 | Park | G09G 3/3233 345/214 |
| 2016/0321994 | A1 * | 11/2016 | Lee | G09G 3/3258 |
| 2017/0148379 | A1 * | 5/2017 | Cho | G09G 3/3233 |

FOREIGN PATENT DOCUMENTS

| | | | |
|---|---|---|---|
| CN | 106023900 | A | 10/2016 |
| JP | 2016048300 | A | 4/2016 |
| JP | 2016128868 | A | 7/2016 |

* cited by examiner

PIXEL CIRCUIT, METHOD FOR DRIVING THE SAME, DISPLAY PANEL AND DISPLAY DEVICE

CROSS-REFERENCE TO RELATED APPLICATIONS

This application claims the priority to Chinese Patent Application No. CN201710717874.2, filed on Aug. 21, 2017, the content of which is hereby incorporated by reference in its entirety.

FIELD

The present disclosure relates to the technical field of displaying, in particular to a pixel circuit, a method for driving the same, a display panel and a display device.

BACKGROUND

Organic Light-Emitting Diode (OLED) displays have become a hot field for flat panel display research. Compared with a Liquid Crystal Display (LCD), an OLED display has advantages in lower power consumption, a lower production cost, a wider viewing angle, a faster response speed and is self-luminous. Among presently existing technologies, OLED displays have come to take the place of traditional LCDs in flat panel displays such as mobile phones, Personal Digital Assistants (PDAs) and digital cameras. Pixel circuit design is a core content of OLED display technology and has great research significance.

SUMMARY

Embodiment of the present disclosure provides a pixel circuit, a method for driving the same, a display panel and a display device, in order to solve an existing problem that the brightness of a first frame is low after images displayed by a pixel circuit have switched from low-grayscale images to high-grayscale images.

A pixel circuit according to the disclosure, the pixel circuit including a driving transistor, a light emission control module, a first initialization module, a second initialization module, a threshold compensation module, a data writing module, a storage module and a light emitting device.

The light emission control module is configured to provide a signal of a first voltage terminal to a first terminal of the driving transistor under the control of a first light emission control terminal and to make a connection between a second terminal of the driving transistor and an anode of the light emitting device conductive under the control of a second light emission control terminal.

The first initialization module is configured to reset a gate of the driving transistor.

The second initialization module is configured to enable the signal of the first voltage terminal to flow through the driving transistor before the light emitting device emits light.

The threshold compensation module is configured to compensate a threshold voltage of the driving transistor. The data writing module is configured to write a data signal of a data signal terminal into the gate of the driving transistor.

The storage module is configured to keep a gate voltage of the driving transistor stable.

The driving transistor is configured to generate a driving current according to the data signal to drive the light emitting device to emit light.

In addition, the embodiment of the present disclosure further provides a display panel including a pixel circuit. The pixel circuit includes a driving transistor, a light emission control module, a first initialization module, a second initialization module, a threshold compensation module, a data writing module, a storage module and a light emitting device. The light emission control module is configured to provide a signal of a first voltage terminal to a first terminal of the driving transistor under the control of a first light emission control terminal and to make a connection between a second terminal of the driving transistor and an anode of the light emitting device conductive under the control of a second light emission control terminal. The first initialization module is configured to reset a gate of the driving transistor. The second initialization module is configured to enable the signal of the first voltage terminal to flow through the driving transistor before the light emitting device emits light. The threshold compensation module is configured to compensate a threshold voltage of the driving transistor. The data writing module is configured to write a data signal of a data signal terminal into the gate of the driving transistor. The storage module is configured to keep a gate voltage of the driving transistor stable. The driving transistor is configured to generate a driving current according to the data signal to drive the light emitting device to emit light.

In addition, the embodiment of the present disclosure further provides a display device including a display panel. The display panel includes a pixel circuit. The pixel circuit includes a driving transistor, a light emission control module, a first initialization module, a second initialization module, a threshold compensation module, a data writing module, a storage module and a light emitting device. The light emission control module is configured to provide a signal of a first voltage terminal to a first terminal of the driving transistor under the control of a first light emission control terminal and to make a connection between a second terminal of the driving transistor and an anode of the light emitting device conductive under the control of a second light emission control terminal. The first initialization module is configured to reset a gate of the driving transistor. The second initialization module is configured to enable the signal of the first voltage terminal to flow through the driving transistor before the light emitting device emits light. The threshold compensation module is configured to compensate a threshold voltage of the driving transistor. The data writing module is configured to write a data signal of a data signal terminal into the gate of the driving transistor. The storage module is configured to keep a gate voltage of the driving transistor stable. The driving transistor is configured to generate a driving current according to the data signal to drive the light emitting device to emit light.

In addition, the embodiment of the present disclosure further provides a method for driving a pixel circuit including a driving transistor, a light emission control module, a first initialization module, a second initialization module, a threshold compensation module, a data writing module, a storage module and a light emitting device, and the method includes the following operations.

At a first stage, providing a first potential signal to a first light emission control terminal and a first scanning signal terminal, and providing a second potential signal to a second light emission control terminal and a second scanning signal terminal. The light emission control module provides the signal of a first voltage terminal to a first terminal of the driving transistor under the control of the first light emission control terminal. The first initialization module provides the signal of a reference signal terminal to a gate of the driving transistor under the control of the first scanning signal terminal And the second initialization module cooperates with the light emission control module and the first initialization module to enable the signal of the first voltage terminal to flow to the reference signal terminal after flowing through the driving transistor under the control of the first scanning signal terminal.

At a second stage, providing a first potential signal to the first scanning signal terminal and providing a second potential signal to the first light emission control terminal, the second light emission control terminal and the second scanning signal terminal. The first initialization module provides the signal of the reference signal terminal to the gate of the driving transistor under the control of the first scanning signal terminal.

At a third stage, providing a first potential signal to the second scanning signal terminal, and providing a second potential signal to the first light emission control terminal, the second light emission control terminal and the first scanning signal terminal. The data writing module writes the signal of the data signal terminal into the first terminal of the driving transistor under the control of the second scanning signal, and the threshold compensation module makes the connection between the gate and a second terminal of the driving transistor conductive under the control of the second scanning signal terminal.

At a fourth stage, providing a first potential signal to the first light emission control terminal and the second light emission control terminal, and providing a second potential signal to the first scanning signal terminal and the second scanning signal terminal. The light emission control module provides the signal of the first voltage terminal to the first terminal of the driving transistor under the control of the first light emission control terminal, and makes the connection between the second terminal of the driving transistor and an anode of the light emitting device conductive under the control of the second light emission control terminal And the driving transistor drives the light emitting device to emit light.

DETAILED DESCRIPTION OF AN EMBODIMENT

In order to make the purposes, technical solutions and advantages of the present disclosure clearer, specific implementation modes of a pixel circuit, a method for driving the same and an organic electroluminescent display panel according to an embodiment of the present disclosure is described below in detail with reference to the drawings. It should be understood that the optional embodiment described below is only used for describing and explaining the present disclosure instead of limiting the present disclosure. Besides, the implementation modes disclosed herein and features thereof can be combined in a case of no conflict.

Figure 4:
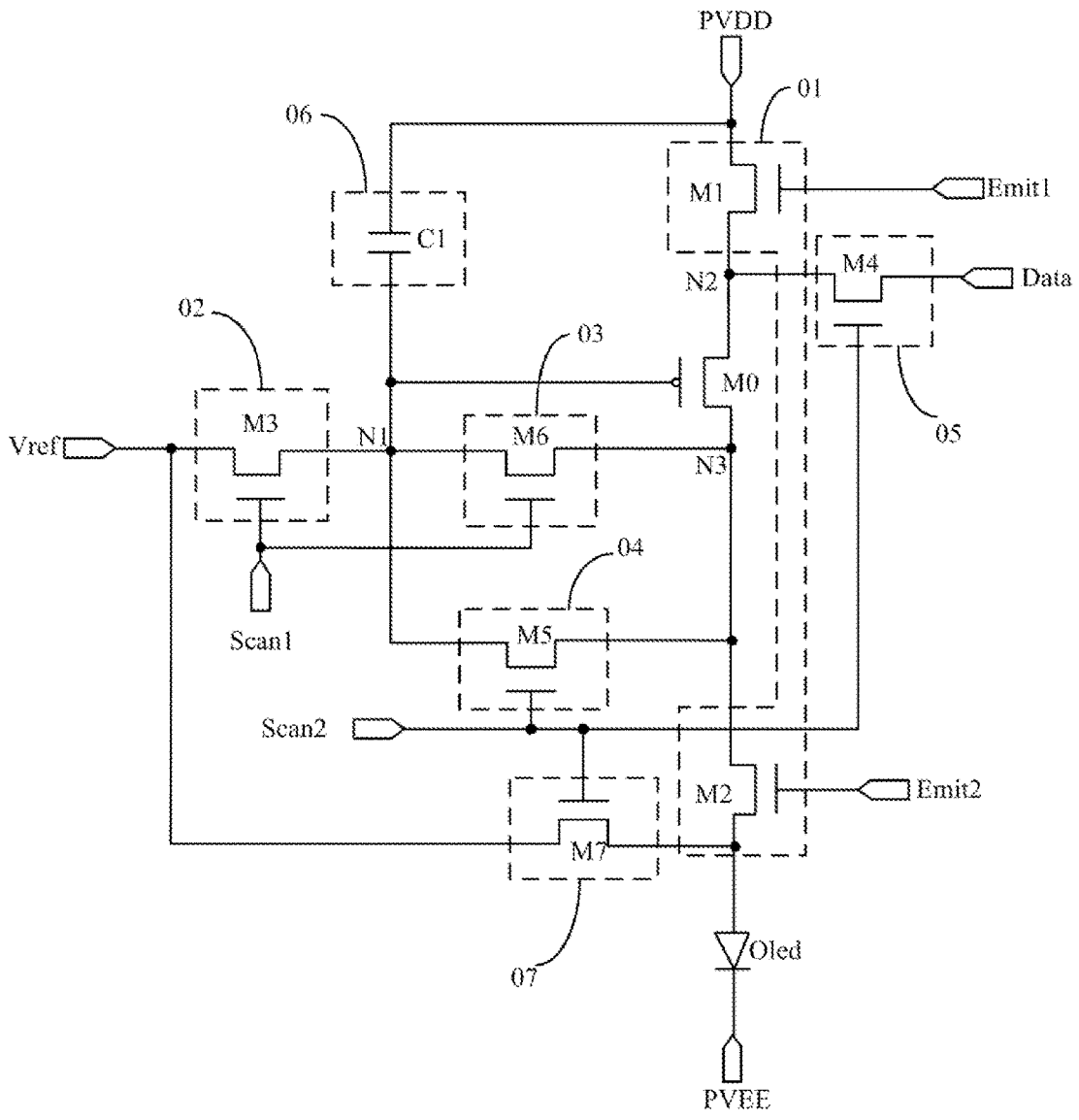
FIG. 4 illustrates a specific circuit schematic diagram of another pixel circuit according to the embodiment of the present disclosure.

As illustrated in FIG. 4, the pixel circuit according to the embodiment of the disclosure includes a driving transistor M0, a light emission control module 01, a first initialization module 02, a second initialization module 03, a threshold compensation module 04, a data writing module 05, a storage module 06 and a light emitting device OLED.

The light emission control module 01 is configured to provide a signal of a first voltage terminal PVDD to a first terminal of the driving transistor M0 under the control of a first light emission control terminal Emit1 and to make a connection between a second terminal of the driving transistor M0 and an anode of the light emitting device OLED conductive under the control of a second light emission control terminal Emit2.

The first initialization module 02 is configured to reset a gate of the driving transistor M0.

The second initialization module 03 is configured to enable the signal of the first voltage terminal PVDD to flow through the driving transistor M0 before the light emitting device OLED emits light.

The threshold compensation module 04 is configured to compensate threshold voltage of the driving transistor M0.

The data writing module 05 is configured to drive a data signal of a data signal terminal Data into the gate of the driving transistor M0.

The storage module 06 is configured to keep a gate voltage of the driving transistor M0 stable.

The driving transistor M0 is configured to generate a driving current according to the data signal to drive the light emitting device OLED to emit light.

The pixel circuit according to the embodiment of the present disclosure utilizes the first initialization module to reset the gate of the driving transistor, utilizes the data writing module to write the data signal, utilizes the threshold compensation module to compensate for threshold voltage drift of the driving transistor, and utilizes the storage module to keep the gate voltage of the driving transistor stable when the light emitting device emits light, thereby improving display non-uniformity caused by the threshold voltage drift of the driving transistor due to manufacturing process and transistor aging through internal compensation. Besides, since the pixel circuit is further provided with the second initialization module and the second initialization module is configured to enable the signal of the first voltage terminal to flow through the driving transistor before the light emitting device emits light, after the pixel circuit displays a low-grayscale image and before the pixel circuit displays a high-grayscale image, a large current is enabled to flow through the driving transistor to compensate for a threshold voltage hysteresis effect of the driving transistor such that the driving transistor can response promptly to drive the light emitting device to emit light, thereby improving the problem that the brightness of a first frame is low after an existing pixel circuit has switched from displaying a low-grayscale image to displaying a high-grayscale image.

Specifically, in the pixel circuit according to the embodiment of the present disclosure, as illustrated in FIG. 4, a cathode of the light emitting device OLED is connected with a second voltage terminal PVEE, and generally the voltage of the second voltage terminal PVEE is negative or grounded.

Specifically, in the pixel circuit according to the embodiment of the present disclosure, generally, the light emitting device OLED is an organic light emitting diode, which is not limited herein.

The present disclosure is described below in detail in combination with specific implementation modes. It should be understood that the implementation modes are used for better explaining the present disclosure instead of limiting the present disclosure.

Specifically, in the pixel circuit according to the embodiment of the present disclosure, as illustrated in FIG. 4, the first initialization module 02 is configured to provide a signal of a reference signal terminal Vref to the gate of the driving transistor M0 under the control of a first scanning signal terminal Scan1.

The second initialization module 03 is configured to cooperate with the light emission control module 01 and the first initialization module to enable the signal of the first voltage terminal PVDD to flow to the reference signal terminal Vref after flowing through the driving transistor M0 under the control of the first scanning signal terminal Scan1.

The data writing module 05 is configured to write a signal of the data signal terminal Data into the first terminal of the driving transistor M0 under the control of a second scanning signal terminal Scan2.

The threshold compensation module 04 is configured to make the gate and the second terminal of the driving transistor M0 under the control of the second scanning signal terminal Scan2.

In this way, the first initialization module 02 provides the signal of the reference signal terminal Vref to the gate of the driving transistor M0 under the control of the first scanning signal terminal Scan1, while the light emission control module 01 provides the signal of the first voltage terminal PVDD to the first terminal of the driving transistor M0 under the control of the first light emission control terminal Emit1, the second initialization module 03 cooperates with the light emission control module 01 and the first initialization module 02 to enable the signal of the first voltage terminal PVDD to flow to the reference signal terminal Vref after flowing through the driving transistor M0, so that a large current is enabled to flow through the driving transistor M0 to compensate for the threshold voltage hysteresis effect of the driving transistor M0. Thereafter, the data writing module writes the signal of the data signal terminal Data into the first terminal of the driving transistor M0 under the control of the second scanning signal terminal Scan2; the threshold compensation module makes a connection between the gate and the second terminal of the driving transistor M0 conductive to write the data signal and a threshold voltage of the driving transistor M0 into the gate of the driving transistor M0, and makes the driving current generated by the driving transistor M0 according to the data signal irrelevant with the threshold voltage of the driving transistor M0. Finally the light emission control module 01 enables the driving current of the driving transistor M0 to flow to the light emitting device OLED to drive the light emitting device OLED to emit light under the control of the first light emission control terminal Emit1 and the second light emission control terminal Emit2.

Figure 5:
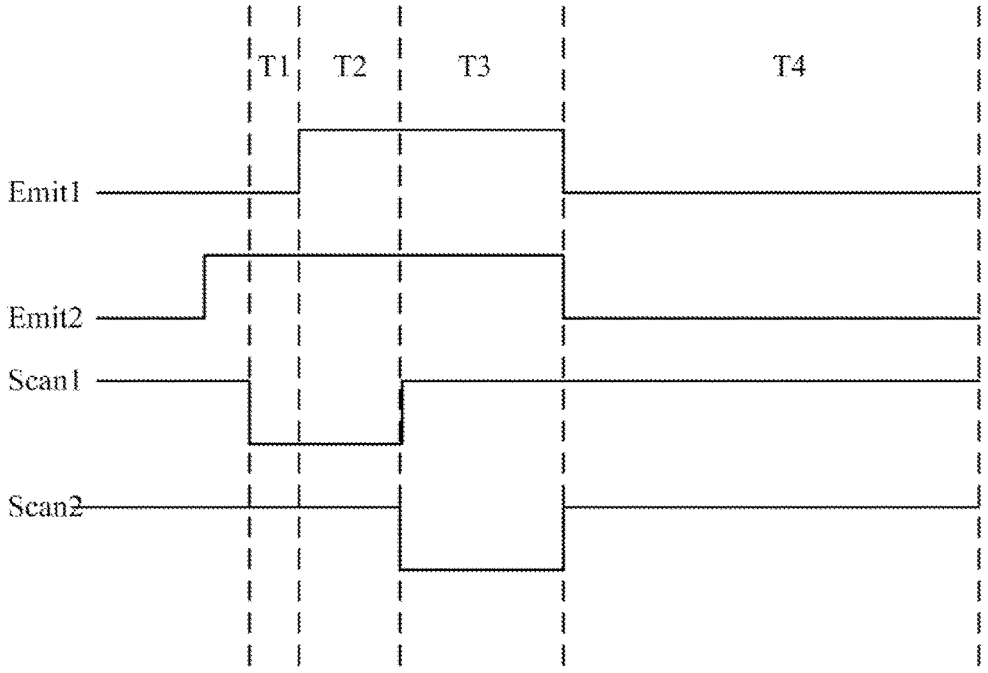
FIG. 5 illustrates a circuit timing diagram corresponding to the pixel circuit illustrated in FIG. 3.

Optionally, as illustrated in FIG. 5, the pixel circuit according to the embodiment of the present disclosure further includes an anode resetting module 07. The anode resetting module 07 is configured to provide the signal of the reference signal terminal Vref to the anode of the light emitting device OLED under the control of the second scanning signal terminal Scan2. In this way, the light emitting device OLED, when emitting light at a current frame, is not influenced by a voltage of light emission at a previous frame.

Figure 6:
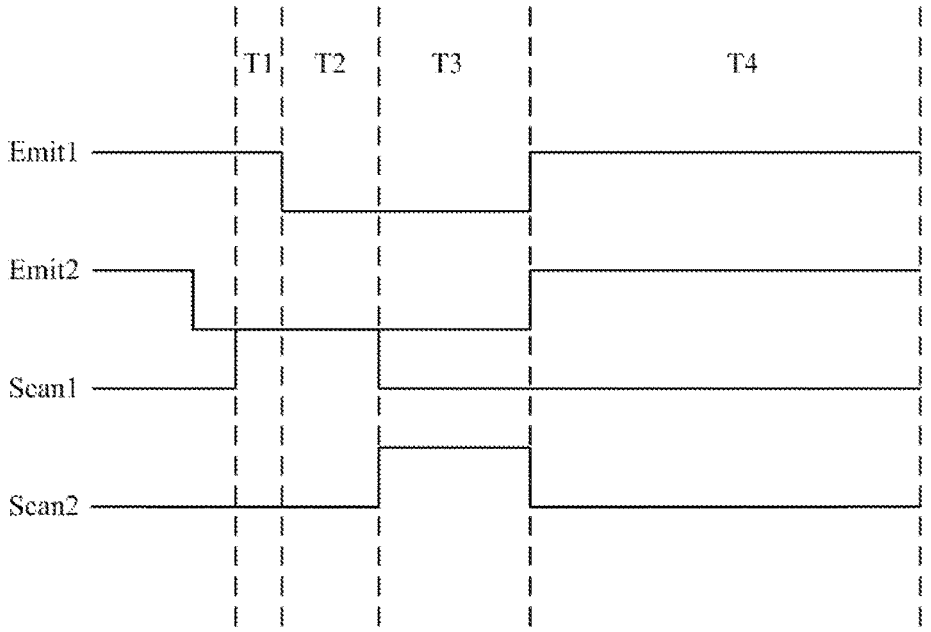
FIG. 6 illustrates a circuit timing diagram corresponding to the pixel circuit illustrated in FIG. 4.
Figure 7:
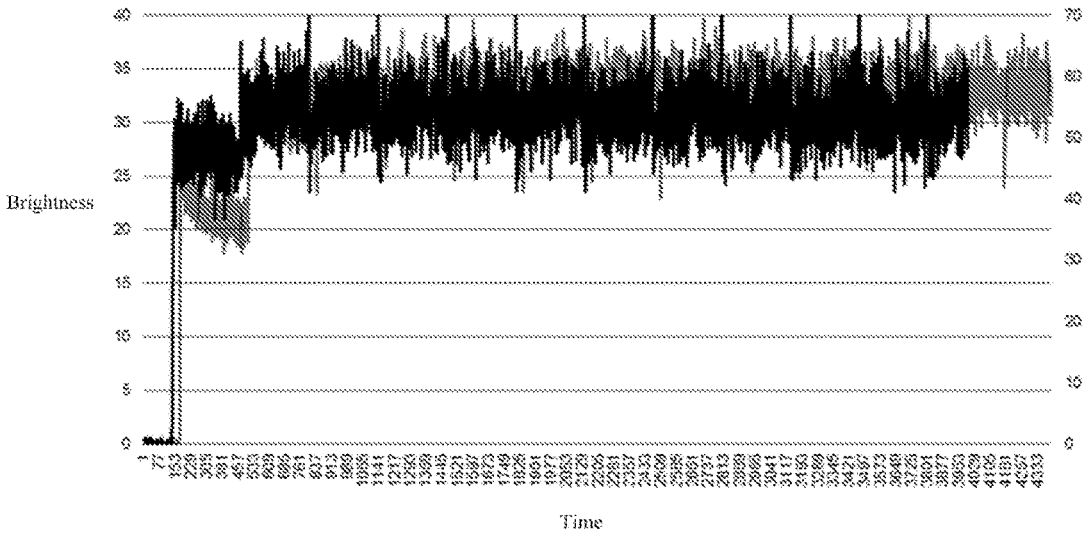
FIG. 7 compares brightness values from the pixel circuit according to the embodiment of the present disclosure and corresponding to the existing pixel circuit after the pixel circuits have switched from displaying a low-grayscale image to displaying a high-grayscale image.

Optionally, in the pixel circuit according to the embodiment of the present disclosure, as illustrated in FIG. 6 and FIG. 7, the light emission control module 01 includes a first switching transistor M1 and a second switching transistor M2.

A gate of the first switching transistor M1 is connected with the first light emission control terminal Emit1, a first terminal of the first switching transistor M1 is connected with the first voltage terminal PVDD and a second terminal of the first switching transistor M1 is connected with the first terminal of the driving transistor M0.

A gate of the second switching transistor M2 is connected with the second light emission control terminal Emit2, a first terminal of the second switching transistor M2 is connected with the second terminal of the driving transistor M0 and a second terminal of the second switching transistor M2 is connected with the anode of the light emitting device OLED.

Specifically, in the pixel circuit according to the embodiment of the present disclosure, when the first light emission control terminal Emit1 controls the first switching transistor M1 to turn on, the signal of the first voltage terminal PVDD is transmitted to the first terminal of the driving transistor M0 through the first switching transistor M1; and when the second light emission control terminal Emit2 controls the second switching transistor M2 to turn on, the connection between the second terminal of the driving transistor M0 and the light emitting device is conductive.

Specifically, in the pixel circuit according to the embodiment of the present disclosure, as illustrated in FIG. 6, the first switching transistor M1 and the second switching transistor M2 are P-type transistors, or as illustrated in FIG. 7, the first switching transistor M1 and the second switching transistor M2 are N-type transistors, which are not limited herein.

The above-mentioned specific structure of the light emission control module in the pixel circuit is just an example. During actual implementation, the specific structure of the light emission control module is not limited to the above-mentioned structure and may also be another structure known by one skilled in the art, which is not limited herein.

Optionally, in the pixel circuit according to the embodiment of the present disclosure, as illustrated in FIG. 6 and FIG. 7, the first initialization module 02 includes a third switching transistor M3.

A gate of the third switching transistor M3 is connected with the first scanning signal terminal Scan1, a first terminal of the third switching transistor M3 is connected with the reference signal terminal Vref and a second terminal of the third switching transistor M3 is connected with the gate of the driving transistor M0.

Specifically, in the pixel circuit according to the embodiment of the present disclosure, when the first scanning signal terminal Scant controls the third switching transistor M3 to turn on, the signal of the reference signal terminal Vref is transmitted to the gate of the driving transistor M0 through the third switching transistor M3 to reset the gate of the driving transistor M0.

Specifically, in the pixel circuit according to the embodiment of the present disclosure, as illustrated in FIG. 6, the third switching transistor M3 is a P-type transistor, or as illustrated in FIG. 7, the third switching transistor M3 is an N-type transistor, which is not limited herein.

The above-mentioned specific structure of the first initialization module in the pixel circuit is just an example. During actual implementation, the specific structure of the first initialization module is not limited to the above-mentioned structure and may also be another structure known by one skilled in the art, which is not limited herein.

Optionally, in the pixel circuit according to the embodiment of the present disclosure, as illustrated in FIG. 6 and FIG. 7, the threshold compensation module 04 includes a fifth switching transistor M5.

A gate of the fifth switching transistor M5 is connected with the second scanning signal terminal Scan2, a first terminal of the fifth switching transistor M5 is connected with the first terminal of the driving transistor M0 and a second terminal of the fifth switching transistor M5 is connected with the gate of the driving transistor M0.

Specifically, in the pixel circuit according to the embodiment of the present disclosure, when the second scanning signal terminal Scan2 controls the fifth switching transistor M5 to be turn on, the connection between the gate and the second terminal of the driving transistor M0 is conductive thereby compensating the threshold voltage.

Specifically, in the pixel circuit according to the embodiment of the present disclosure, as illustrated in FIG. 6, the fifth switching transistor M5 is a P-type transistor, or as illustrated in FIG. 7, the fifth switching transistor M5 is an N-type transistor, which is not limited herein.

The above-mentioned specific structure of the threshold compensation module in the pixel circuit is just an example. During actual implementation, the specific structure of the threshold compensation module is not limited to the above-mentioned structure and may also be another structure known by one skilled in the art, which is not limited herein.

Optionally, in the pixel circuit according to the embodiment of the present disclosure, as illustrated in FIG. 6 and FIG. 7, the data writing module 05 includes a fourth switching transistor M4.

A gate of the fourth switching transistor M4 is connected with the second scanning signal terminal Scan2, a first terminal of the fourth switching transistor M4 is connected with the data signal terminal Data and a second terminal of the fourth switching transistor M4 is connected with the first terminal of the driving transistor M0.

Specifically, in the pixel circuit according to the embodiment of the present disclosure, when the second scanning signal terminal Scan2 controls the fourth switching transistor M4 to turn on, the data signal of the data signal terminal Data is transmitted to the first terminal of the driving transistor M0 through the fourth switching transistor M4 to write data.

Specifically, in the pixel circuit according to the embodiment of the present disclosure, as illustrated in FIG. 6, the fourth switching transistor M4 is a P-type transistor, or as illustrated in FIG. 7, the fourth switching transistor M4 is an N-type transistor, which is not limited herein.

The above-mentioned specific structure of the data writing module in the pixel circuit is just an example. During actual implementation, the specific structure of the data writing module is not limited to the above-mentioned structure and may also be another structure known by one skilled in the art, which is not limited herein.

Optionally, in the pixel circuit according to the embodiment of the present disclosure, as illustrated in FIG. 6 and FIG. 7, the storage module 06 includes a capacitor C1. One terminal of the capacitor C1 is connected with the first voltage terminal PVDD and the other terminal is connected with the gate of the driving transistor M0.

Optionally, in the pixel circuit according to the embodiment of the present disclosure, as illustrated in FIG. 6 and FIG. 7, the second initialization module 03 includes a sixth switching transistor M6.

A gate of the sixth switching transistor M6 is connected with the first scanning signal terminal Scan1, a first terminal of the sixth switching transistor M6 is connected with the first terminal of the driving transistor M0 and a second terminal of the sixth switching transistor M6 is connected with the gate of the driving transistor M0.

Specifically, in the pixel circuit according to the embodiment of the present disclosure, when the first scanning signal terminal Scan1 controls the sixth switching transistor M6 to turn on, the connection between the gate and the second terminal of the driving transistor M0 is conductive, the sixth switching transistor M6 cooperates with the third switching transistor M3 and the first switching transistor M1 to enable the signal of the first voltage terminal PVDD to pass through the first switching transistor M1, then the driving transistor M0, then the sixth switching transistor M6 and then the third switching transistor M3 to flow to the reference signal terminal, so that a large current could flow through the driving transistor M0 before the light emitting device OLED emits light to compensate for the threshold voltage hysteresis effect of the driving transistor M0.

Specifically, in the pixel circuit according to the embodiment of the present disclosure, as illustrated in FIG. 6, the sixth switching transistor M6 is a P-type transistor, or as illustrated in FIG. 7, the sixth switching transistor M6 is an N-type transistor, which is not limited herein.

The above-mentioned specific structure of the second initialization module in the pixel circuit is just an example. During actual implementation, the specific structure of the second initialization module is not limited to the above-mentioned structure and may also be another structure known by one skilled in the art, which is not limited herein.

Optionally, in the pixel circuit according to the embodiment of the present disclosure, as illustrated in FIG. 6 and FIG. 7, the anode resetting module 07 includes a seventh switching transistor M7.

A gate of the seventh switching transistor M7 is connected with the second scanning signal terminal Scan2, a first terminal of the seventh switching transistor M7 is connected with the reference signal terminal Vref and a second terminal of the seventh switching transistor M7 is connected with the anode of the light emitting device OLED.

Specifically, in the pixel circuit according to the embodiment of the present disclosure, when the second scanning signal terminal Scan2 controls the seventh switching transistor M7 to turn on, the signal of the reference signal terminal Vref is transmitted to the anode of the light emitting device OLED through the seventh switching transistor M7 to reset the anode of the light emitting device OLED.

Specifically, in the pixel circuit according to the embodiment of the present disclosure, as illustrated in FIG. 6, the seventh switching transistor M7 is a P-type transistor, or as illustrated in FIG. 7, the seventh switching transistor M7 is an N-type transistor, which is not limited herein.

The above-mentioned specific structure of the anode resetting module in the pixel circuit is just an example During actual implementation, the specific structure of the anode resetting module is not limited to the above-mentioned structure and may also be another structure known by one skilled in the art, which is not limited herein.

Specifically, in order to unify manufacturing processes, in the pixel circuit according to the embodiment of the present disclosure, as illustrated in FIG. 6, all the transistors are P-type transistors; or as illustrated in FIG. 7, all the transistors are N-type transistors.

Specifically, in the pixel circuit according to the embodiment of the present disclosure, an N-type transistor turns on under the influence of a high-potential signal and is cut off under the influence of a low-potential signal. And a P-type transistor turns on under the influence of a low-potential signal and is cut off under the influence of a high-potential signal.

Specifically, in the pixel circuit according to the embodiment of the present disclosure, the first terminal of the transistor may be a source and the second terminal thereof is a drain, or the first terminal of the transistor may be a drain and the second terminal thereof is a source, which are not specifically distinguished herein.

Specifically, in the pixel circuit according to the embodiment of the present disclosure, in order to reduce the leakage current, any of the switching transistors may be configured to have a dual-gate structure, which is not limited herein.

Specifically, in the pixel circuit according to the embodiment of the present disclosure, the width-length ratio of the channel of the driving transistor is smaller than the width-length ratio of the channel of any switching transistor.

During actual implementation, in the display panel according to the embodiment of the present disclosure, the driving transistor M0 is a P-type transistor. In a case where the driving transistor M0 is an N-type transistor, the design principle is the same as the present disclosure and it is also included in the protection scope of the present disclosure.

Specifically, in the pixel circuit according to the embodiment of the present disclosure, as illustrated in FIG. 6 and FIG. 7, it is specified that the gate of the driving transistor M0 is a first node N1, the first terminal of the driving transistor M0 is a second node N2 and the second terminal of the driving transistor M0 is a third node N3.

The operation process of the pixel circuit according to the embodiment of the present disclosure is described below with reference to the circuit timing diagram. In the description below, 1 represents high potential and 0 represents low potential. 1 and 0 are logical potentials and are just used for better explaining the specific operation process of the embodiment of the present disclosure instead of representing specific voltage values.

Example 1

Figure 8:
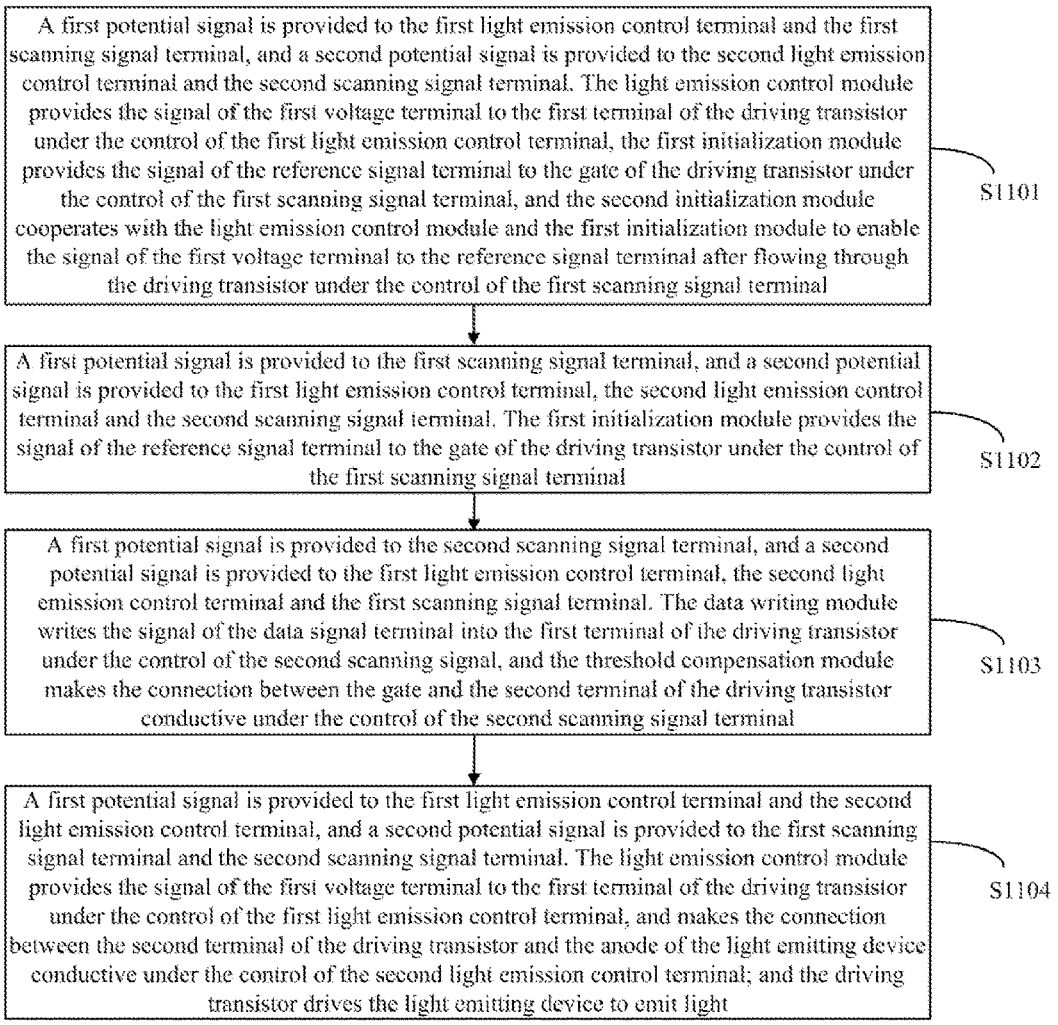
FIG. 8 illustrates a flowchart of a method for providing a pixel circuit according to the embodiment of the present disclosure.

By taking the pixel circuit illustrated by FIG. 6 as an example, all the transistors are P-type transistors and a corresponding input/output timing is illustrated by FIG. 8. Specifically, four stages, i.e., T1, T2, T3 and T4 in the input timing diagram illustrated by FIG. 8 are selected.

At stage T1 (i.e., an initialization stage 1), Scan1=0, Scan2=1, Emit1=0 and Emit2=1.

Since Emit1=0, the first switching transistor M1 turns on, the signal of the first voltage terminal PVDD is transmitted to the second node N2 through the first switching transistor M1, and thus the potential of the second node N2 is VDD. Since Scan1=0, the connection between the third switching transistor M3 and the sixth switching transistor M6 is conductive. The signal of the reference signal terminal Vref is transmitted to the first node N1 through the third switching transistor M3, and thus the potential of the first node N1 is Vref, the driving transistor M0 turns on, the signal of the first voltage terminal PVDD flows to the reference signal terminal Vref via the driving transistor M0, and a large current flows through the driving transistor M0 to compensate for the threshold voltage hysteresis effect of the driving transistor M0. Since Scan2=1, the fourth switching transistor M4, the fifth switching transistor M5 and the seventh switching transistor M7 are cut off. And since Emit2=1, the second switching transistor M2 is cut off and the light emitting device OLED does not emit light.

At stage T2 (i.e., an initialization stage 2), Scan1=0, Scan2=1, Emit1=1 and Emit2=1.

Since Scan1=0, the third switching transistor M3 and the sixth switching transistor M6 turn on. The signal of the reference signal terminal Vref is transmitted to the first node N1 through the third switching transistor M3, and thus the potential of the first node N1 is Vref. Since Scan2=1, the fourth switching transistor M4, the fifth switching transistor M5 and the seventh switching transistor M7 are cut off. Since Emit1=0, the first switching transistor M1 is cut off. And since Emit2=1, the second switching transistor M2 is cut off and the light emitting device OLED does not emit light.

At stage T3 (i.e., a data writing stage), Scan1=1, Scan2=0, Emit1=1 and Emit2=1.

Since Scan2=0, the fourth switching transistor M4, the fifth switching transistor M5 and the seventh switching transistor M7 turn on. The data signal of the data signal terminal Data is transmitted to the second node N2 through the fourth switching transistor M4, the potential of the second node N2 becomes Vdata. The fifth switching transistor M5 makes the connection between the gate and the second terminal of the driving transistor M0 conductive, and the potentials of the first node N1 and the third node N3 become Vdata−|Vth|. The seventh switching transistor M7 provides the signal of the reference signal terminal Vref to the light emitting device OLED to reset the anode of the light emitting device OLED. Since Scan1=1, the third switching transistor M3 and the sixth switching transistor M6 are cut off. Since Emit1=0, the first switching transistor M1 is cut off. And since Emit2=1, the second switching transistor M2 is cut off and the light emitting device OLED does not emit light.

At stage T4 (i.e., a light emission stage), Scan1=1, Scan2=1, Emit1=0 and Emit2=0.

Since Scan1=1, the third switching transistor M3 and the sixth switching transistor M6 are cut off. Since Scan2=1, the fourth switching transistor M4, the fifth switching transistor M5 and the seventh switching transistor M7 turn on. Since Emit1=0, the first switching transistor M1 turns on, the signal of the first voltage terminal PVDD is transmitted to the first terminal of the driving transistor M0 through the first switching transistor M1, and the potential of the second node N2 becomes VDD. Then the gate-source voltage Vsg of the driving transistor M0 equals to VDD−Vdata+|Vth|, and the driving current I of the driving transistor M0 is $K(Vsg-|Vth|)^2=K(PVDD-Vdata)^2$. Since Emit2=1, the second switching transistor M2 turns on to enable the driving current of the driving transistor M0 to drive the light emitting device OLED to work and emit light.

K is a structural parameter, whose numerical value in a same structure is relatively stable and can be considered as a constant. It can be seen that the current flowing to the light emitting device OLED is not influenced by the threshold voltage of the driving transistor, the influence on the driving transistor due to the threshold voltage drift is avoided and thus the display non-uniformity of the panel is improved.

Example 2

Figure 9:
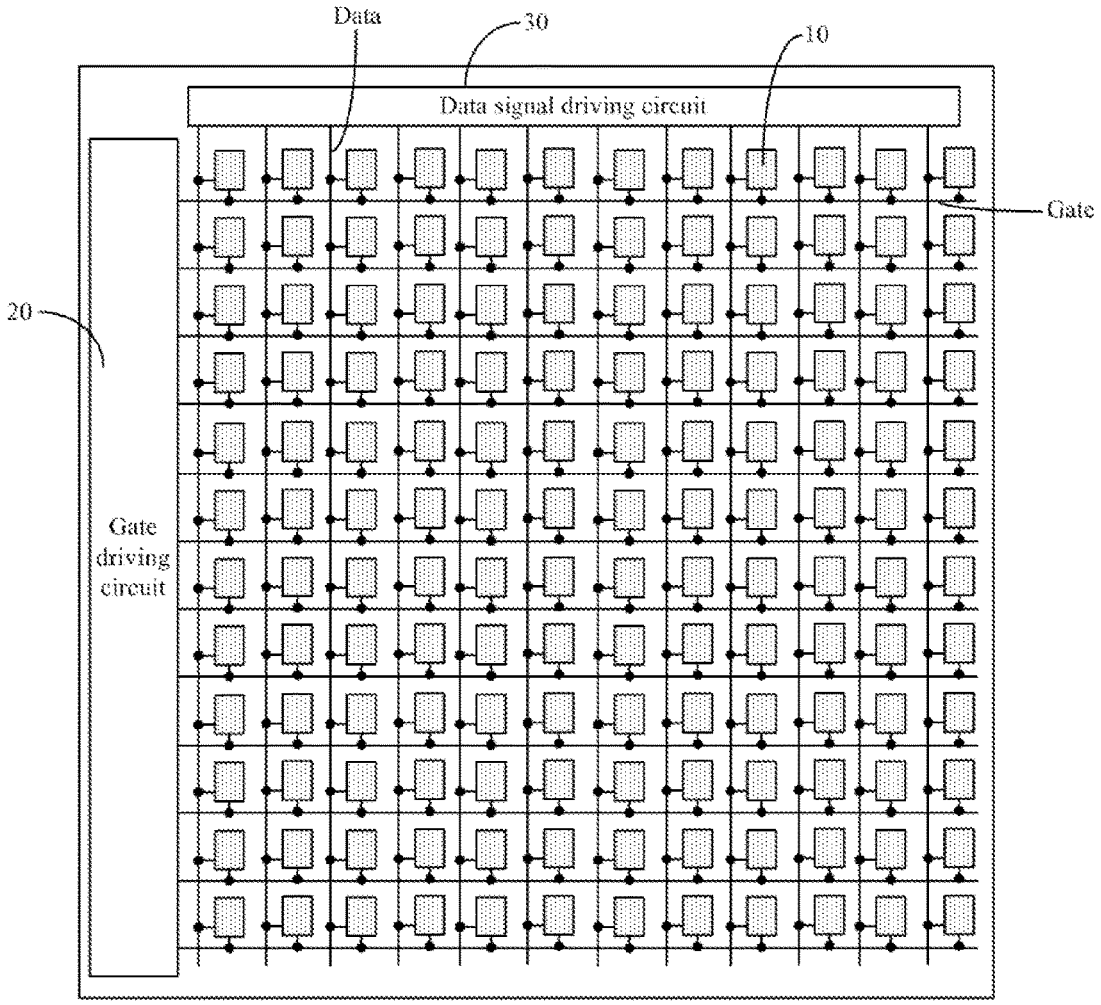
FIG. 9 illustrates a structural schematic diagram of a display panel according to the embodiment of the present disclosure.

Taking the pixel circuit illustrated by FIG. 7 as an example, all switching transistors are N-type transistors and a corresponding input/output timing is illustrated by FIG. 9. Specifically, four stages, i.e., T1, T2, T3 and T4 in the input timing diagram illustrated in FIG. 8 are selected.

At stage T1 (i.e., an initialization stage 1), Scan1=1, Scan2=0, Emit1=1 and Emit2=0.

Since Emit1=1, the first switching transistor M1 turns on, the signal of the first voltage terminal PVDD is transmitted to the second node N2 through the first switching transistor M1, and the potential of the second node N2 is VDD. Since Scan1=1, the third switching transistor M3 and the sixth switching transistor M6 turn on. The signal of the reference signal terminal Vref is transmitted to the first node N1 through the third switching transistor M3, and thus the potential of the first node N1 is Vref, the driving transistor M0 turns on, and the signal of the first voltage terminal PVDD flows to the reference signal terminal Vref via the driving transistor M0. Therefore, a large current flows through the driving transistor M0 to compensate for the threshold voltage hysteresis effect of the driving transistor M0. Since Scan2=0, the fourth switching transistor M4, the fifth switching transistor M5 and the seventh switching transistor M7 are cut off. Since Emit2=0, the second switching transistor M2 is cut off and the light emitting device OLED does not emit light.

At stage T2 (i.e., an initialization stage 2), Scan1=1, Scan2=0, Emit1=0 and Emit2=0.

Since Scan1=1, the third switching transistor M3 and the sixth switching transistor M6 turn on. The signal of the reference signal terminal Vref is transmitted to the first node N1 through the third switching transistor M3, and thus the potential of the first node N1 is Vref. Since Scan2=0, the fourth switching transistor M4, the fifth switching transistor M5 and the seventh switching transistor M7 are cut off. Since Emit1=1, the first switching transistor M1 is cut off. Since Emit2=0, the second switching transistor M2 is cut off and the light emitting device OLED does not emit light.

At stage T3 (i.e., a data writing stage 2), Scan1=0, Scan2=1, Emit1=0 and Emit2=0.

Since Scan2=1, the fourth switching transistor M4, the fifth switching transistor M5 and the seventh switching transistor M7 turn on. The data signal of the data signal terminal Data is transmitted to the second node N2 through the fourth switching transistor M4, and the potential of the second node N2 becomes Vdata. The fifth switching transistor M5 makes the connection between the gate and the second terminal of the driving transistor M0 conductive, and the potentials of the first node N1 and the third node N3 become Vdata-|Vth|. The seventh switching transistor M7 provides the signal of the reference signal terminal Vref to the light emitting device OLED to reset the anode of the light emitting device OLED. Since Scan1=0, the third switching transistor M3 and the sixth switching transistor M6 are cut off. Since Emit1=1, the first switching transistor M1 is cut off. Since Emit2=0, the second switching transistor M2 is cut off and the light emitting device OLED does not emit light.

At stage T4 (i.e., a light emission stage), Scan1=0, Scan2=0, Emit1=1 and Emit2=1.

Since Scan1=0, the third switching transistor M3 and the sixth switching transistor M6 are cut off. Since Scan2=0, the fourth switching transistor M4, the fifth switching transistor M5 and the seventh switching transistor M7 turn on. Since Emit1=1, the first switching transistor M1 turns on, the signal of the first voltage terminal PVDD is transmitted to the first terminal of the driving transistor M0 through the first switching transistor M1, and the potential of the second node N2 becomes VDD. Then the gate-source voltage Vsg of the driving transistor M0 equals to VDD-Vdata+|Vth|, and the driving current I of the driving transistor M0 is $K(Vsg-|Vth|)^2=K(PVDD-Vdata)^2$. Since Emit2=0, the second switching transistor M2 turns on to enable the driving current of the driving transistor M0 to drive the light emitting device OLED to work and emit light.

K is a structural parameter, whose numerical value in a same structure is relatively stable and may be considered as a constant. It can be seen that the current flowing to the light emitting device OLED is not influenced by the threshold voltage of the driving transistor, the influence on the driving transistor due to the threshold voltage drift is avoided and thus the display non-uniformity of the panel is improved.

Figure 1:
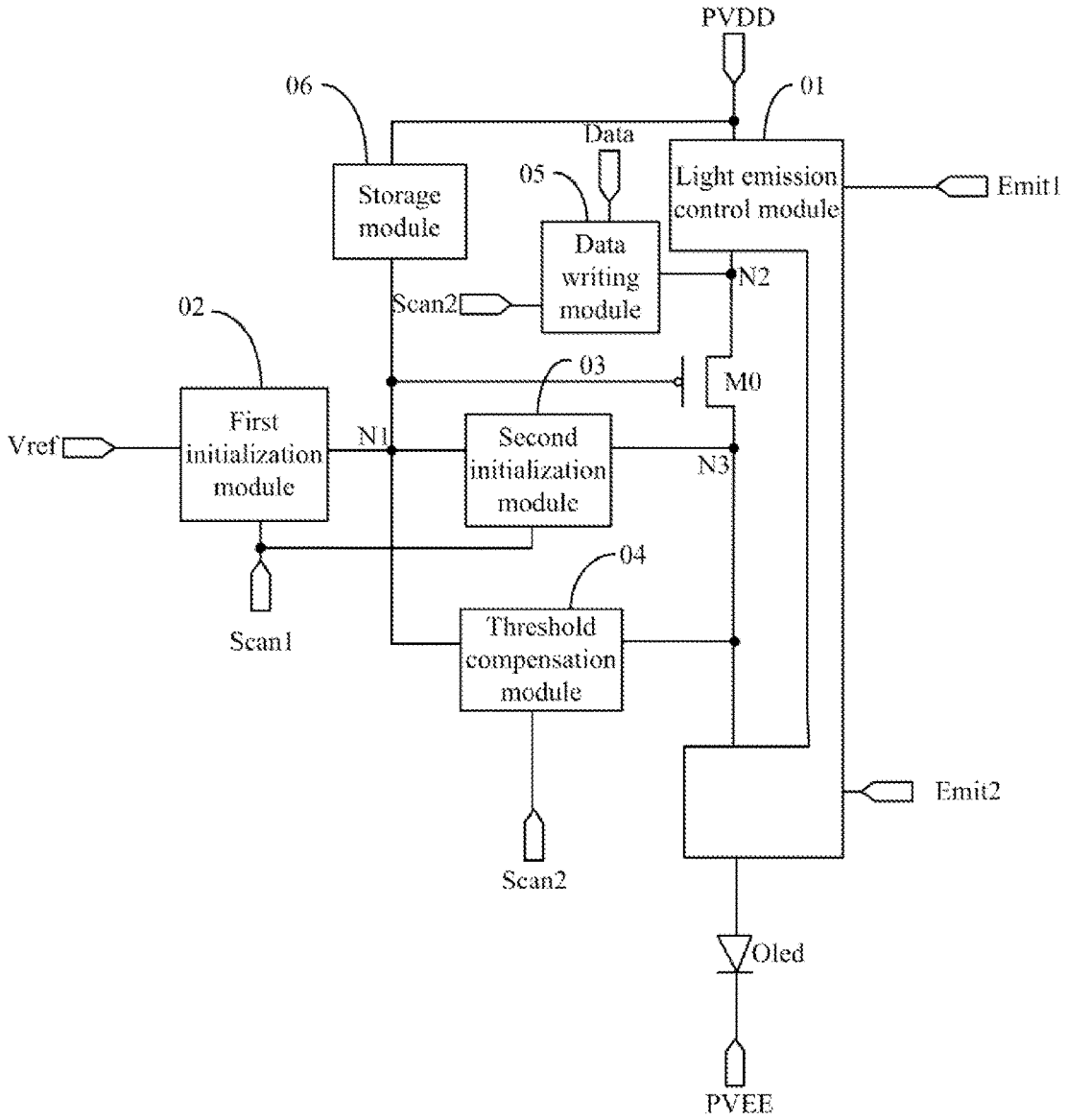
FIG. 1 illustrates a circuit schematic diagram of a pixel circuit according to the embodiment of the present disclosure.
Figure 2:
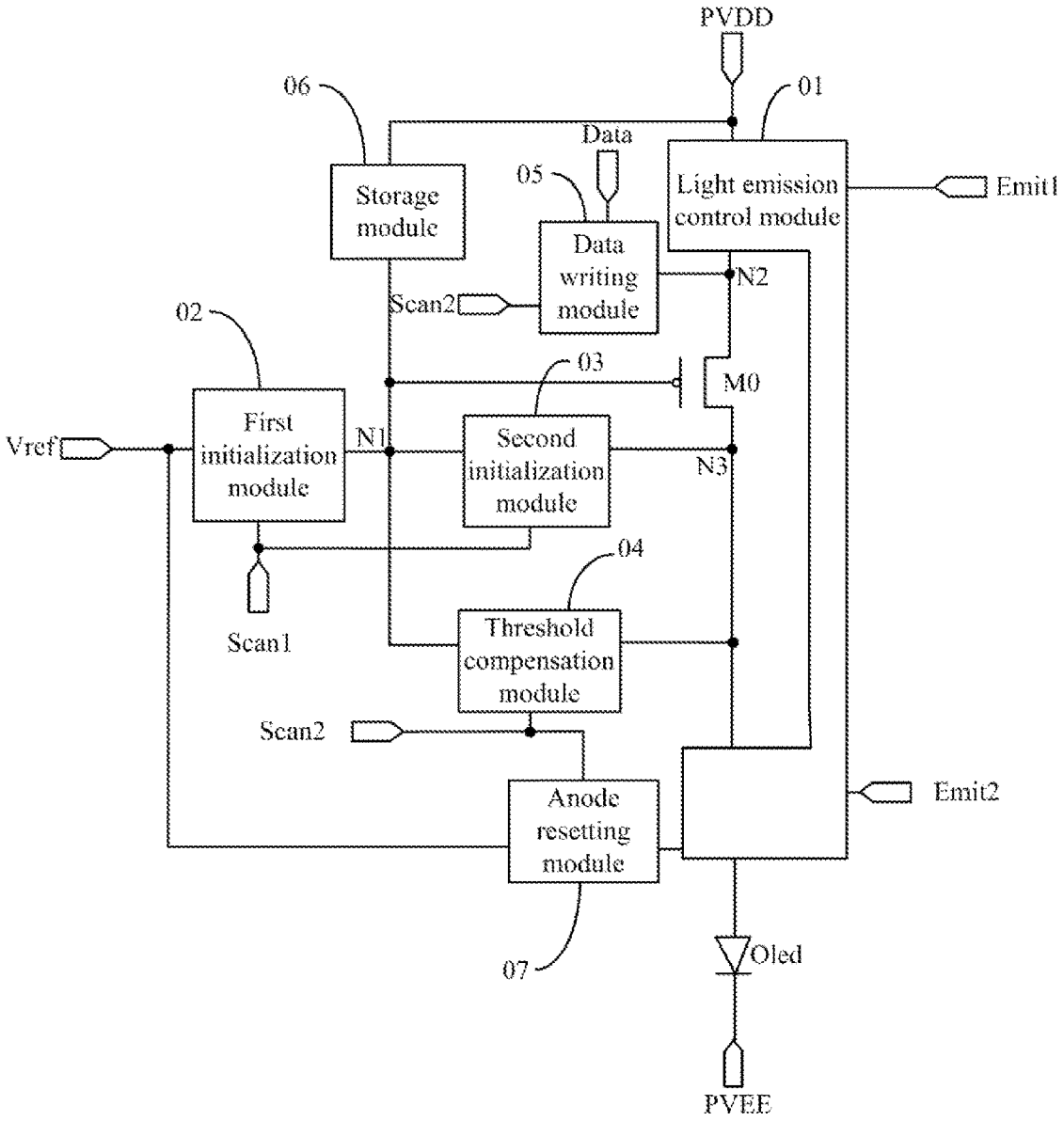
FIG. 2 illustrates a circuit schematic diagram of another pixel circuit according to the embodiment of the present disclosure.
Figure 3:
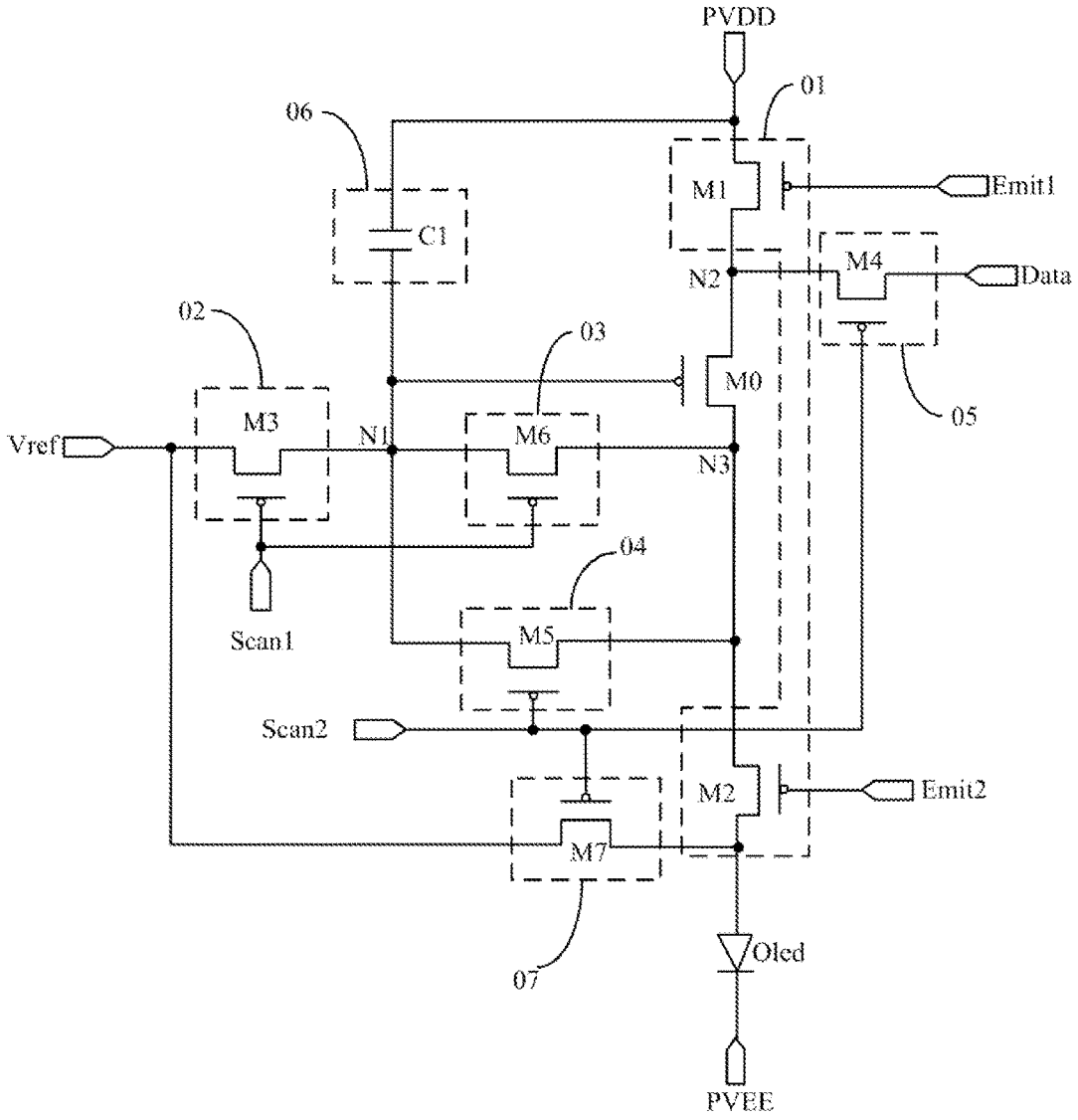
FIG. 3 illustrates a specific circuit schematic diagram of a pixel circuit according to the embodiment of the present disclosure.
Figure 10:
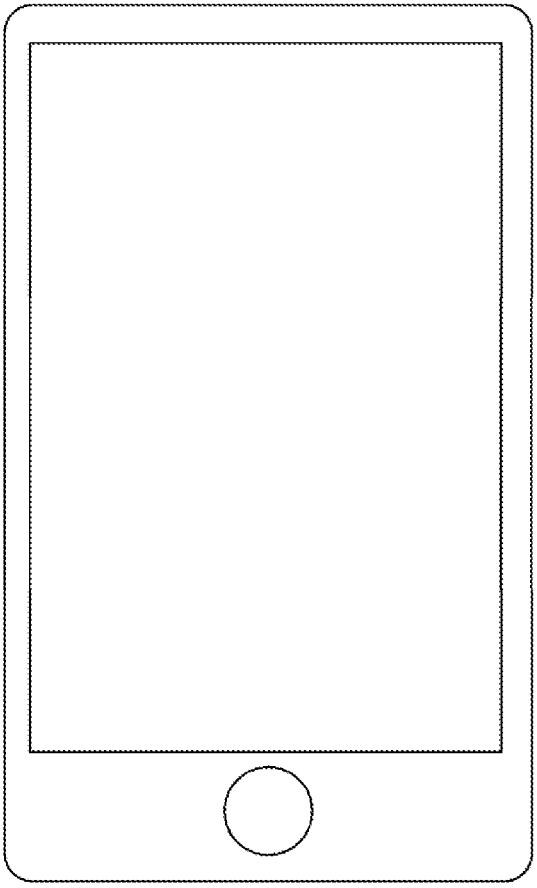
FIG. 10 illustrates a structural schematic diagram of a display device according to the embodiment of the present disclosure.

A comparison is made between brightness values corresponding to the pixel circuit according to the embodiment of the present disclosure and the pixel circuit illustrated in FIG. 1 after switching from displaying a low-grayscale image to displaying a high-grayscale image. As illustrated in FIG. 10, black lines represent brightness values corresponding to the pixel circuit according to the embodiment of the present disclosure, and gray lines represent brightness values corresponding to the pixel circuit illustrated in FIG. 1. From FIG. 10, it can be seen that the pixel circuit according to the embodiment of the present disclosure effectively solve the problem that the brightness of a first frame is low after an existing pixel circuit has switched from displaying a low-grayscale image to displaying a high-grayscale image. Since the pixel circuit according to the embodiment of the present disclosure uses the second initialization module for enabling the signal of the first voltage terminal to flow through the driving transistor before the light emitting device emits light, after the pixel circuit displays a low-grayscale image and before the pixel circuit displays a high-grayscale image, a large current is enabled to flow through the driving transistor to compensate for the threshold voltage hysteresis effect of the driving transistor.

Based on the same inventive concept, the embodiment of the present disclosure further provides a method for driving any one of the above-mentioned pixel circuits. As illustrated in FIG. 11, the method includes the following operations.

In an operation S1101, at a first stage, a first potential signal is provided to the first light emission control terminal and the first scanning signal terminal, and a second potential signal is provided to the second light emission control terminal and the second scanning signal terminal. The light emission control module provides the signal of the first voltage terminal to the first terminal of the driving transistor under the control of the first light emission control terminal, the first initialization module provides the signal of the reference signal terminal to the gate of the driving transistor under the control of the first scanning signal terminal, and the second initialization module cooperates with the light emission control module and the first initialization module to enable the signal of the first voltage terminal to the reference signal terminal after flowing through the driving transistor under the control of the first scanning signal terminal.

In an operation S1102, at a second stage, a first potential signal is provided to the first scanning signal terminal, and a second potential signal is provided to the first light emission control terminal, the second light emission control terminal and the second scanning signal terminal. The first initialization module provides the signal of the reference signal terminal to the gate of the driving transistor under the control of the first scanning signal terminal.

In an operation S1103, at a third stage, a first potential signal is provided to the second scanning signal terminal, and a second potential signal is provided to the first light emission control terminal, the second light emission control terminal and the first scanning signal terminal. The data writing module writes the signal of the data signal terminal into the first terminal of the driving transistor under the control of the second scanning signal, and the threshold compensation module makes the connection between the gate and the second terminal of the driving transistor conductive under the control of the second scanning signal terminal.

In an operation S1104, at a fourth stage, a first potential signal is provided to the first light emission control terminal and the second light emission control terminal, and a second potential signal is provided to the first scanning signal terminal and the second scanning signal terminal. The light emission control module provides the signal of the first voltage terminal to the first terminal of the driving transistor under the control of the first light emission control terminal, and makes the connection between the second terminal of the driving transistor and the anode of the light emitting device conductive under the control of the second light emission control terminal; and the driving transistor drives the light emitting device to emit light.

Specifically, as illustrated in FIG. 6, when the pixel circuit includes a driving transistor M0, a capacitor C1, a first switching transistor M1, a second switching transistor M2, a third switching transistor M3, a fourth switching transistor M4, a fifth switching transistor M5, a sixth switching transistor M6 and a seventh switching transistor M7, and all the transistors are P-type transistors, in the method according to the embodiment of the present disclosure, the first potential signal is a low-potential signal, the second potential signal is a high-potential signal. And the method includes the following operations.

At the first stage, a low-potential signal is provided to the first light emission control terminal and the first scanning signal terminal, and a high-potential signal is provided to the second light emission control terminal and the second scanning signal terminal. The first switching transistor turns on to provide the signal of the first voltage terminal to the first terminal of the driving transistor, the third switching transistor turns on to provide the signal of the reference signal terminal to the gate of the driving transistor, and the sixth switching transistor turns on and cooperates with the turning-on first switching transistor and third switching transistor to enable the signal of the first voltage terminal to flow to the reference signal terminal after flowing through the driving transistor.

At the second stage, a low-potential signal is provided to the first scanning signal terminal, and a high-potential signal is provided to the first light emission control terminal, the second light emission control terminal and the second scanning signal terminal. The third switching transistor turns on to provide the signal of the reference signal terminal to the gate of the driving transistor.

At the third state, a low-potential signal is provided to the second scanning signal terminal, and a high-potential signal is provided to the first light emission control terminal, the second light emission control terminal and the first scanning signal terminal. The fourth switching transistor turns on to write the signal of the data signal terminal into the first terminal of the driving transistor, and the fifth switching transistor turns on to make the connection between the gate and the second terminal of the driving transistor.

At the fourth stage, a low-potential signal is provided to the first light emission control terminal and the second light emission control terminal, and a high-potential signal is provided to the first scanning signal terminal and the second scanning signal terminal. The first switching transistor turns on to provide the signal of the first voltage terminal to the first terminal of the driving transistor, and the second switching transistor turns on to make the connection between the second terminal of the driving transistor and the anode of the light emitting device conductive; and the driving transistor drives the light emitting device to emit light.

Specifically, the timing diagram corresponding to the above-mentioned method is illustrated by FIG. 8. For specific working principles, which are not repeated again herein, please refer to example 1.

Specifically, as illustrated in FIG. 7, when the pixel circuit includes a driving transistor M0, a capacitor C1, a first switching transistor M1, a second switching transistor M2, a third switching transistor M3, a fourth switching transistor M4, a fifth switching transistor M5, a sixth switching transistor M6 and a seventh switching transistor M7, and all the transistors are N-type transistors, in the method according to the embodiment of the present disclosure, the first potential signal is a high-potential signal, the second potential signal is a low-potential signal. And the method includes the following operations.

At the first stage, a high-potential signal is provided to the first light emission control terminal and the first scanning signal terminal, and a low-potential signal is provided to the second light emission control terminal and the second scanning signal terminal. The first switching transistor turns on to provide the signal of the first voltage terminal to the first terminal of the driving transistor, the third switching transistor turns on to provide the signal of the reference signal terminal to the gate of the driving transistor, and the sixth switching transistor turns on and cooperates with the turning-on first switching transistor and third switching transistor to enable the signal of the first voltage terminal to flow to the reference signal terminal after flowing through the driving transistor.

At the second stage, a high-potential signal is provided to the first scanning signal terminal, and a low-potential signal is provided to the first light emission control terminal, the second light emission control terminal and the second scanning signal terminal. The third switching transistor turns on to provide the signal of the reference signal terminal to the gate of the driving transistor.

At the third state, a high-potential signal is provided to the second scanning signal terminal, and a low-potential signal is provided to the first light emission control terminal, the second light emission control terminal and the first scanning signal terminal. The fourth switching transistor turns on to write the signal of the data signal terminal into the first terminal of the driving transistor, and the fifth switching transistor turns on to make the connection between the gate and the second terminal of the driving transistor conductive.

At the fourth stage, a high-potential signal is provided to the first light emission control terminal and the second light emission control terminal, and a low-potential signal is provided to the first scanning signal terminal and the second scanning signal terminal. The first switching transistor turns on to provide the signal of the first voltage terminal to the first terminal of the driving transistor, and the second switching transistor turns on to make the connection between the second terminal of the driving transistor and the anode of the light emitting device conductive; and the driving transistor drives the light emitting device to emit light.

Specifically, the timing diagram corresponding to the above-mentioned method is illustrated by FIG. 9. For specific working principles, which are not repeated herein, please refer to example 1.

Based on the same inventive concept, the embodiment of the present disclosure further provides a display panel. As illustrated in FIG. 12, the display panel includes any one of the abovementioned pixel circuits 10 according to the embodiment of the present disclosure. The display panel generally further includes a gate line Gate, a data line data, a gate driving circuit 20, a data signal driving circuit 30, and etc. Since the principles adopted by the display panel for solving the problem are similar to that adopted by the above-mentioned pixel circuit, the display panel may be implemented with reference to the implementation of the above-mentioned pixel circuit, and details are not repeated herein.

Based on the same inventive concept, the embodiment of the present disclosure further provides a display device including any one of the above-mentioned display panels according to the embodiment of the present disclosure. The display device may be a mobile phone as illustrated by FIG. 13, or may be any other product or component having a display function such as a tablet computer, a television, a display, a notebook computer, a digital photo frame or a navigator. Since the principles adopted by the display device for solving the problem are similar to that adopted by the above-mentioned display panel, the display device may be implemented with reference to the implementation of the above-mentioned display panel, and details are not repeated herein.

The pixel circuit, the method for driving the same, the display panel and the display device according to the embodiment of the present disclosure, utilize the first initialization module to reset the gate of the driving transistor, utilize the data writing module to write the data signal, utilize the threshold compensation module to compensate for threshold voltage drift of the driving transistor, and utilize the storage module to keep the gate voltage of the driving transistor stable when the light emitting device emits light, thereby improving display non-uniformity caused by the threshold voltage drift of the driving transistor due to manufacturing process and transistor aging through internal compensation. Besides, since the pixel circuit is further provided with the second initialization module and the second initialization module is configured to enable the signal of the first voltage terminal to flow through the driving transistor before the light emitting device emits light, after the pixel circuit displays a low-grayscale image and before the pixel circuit displays a high-grayscale image, a large current is enabled to flow through the driving transistor to compensate for a threshold voltage hysteresis effect of the driving transistor such that the driving transistor can response promptly to drive the light emitting device to emit light, thereby improving the problem that the brightness of a first frame is low after an existing pixel circuit has switched from displaying a low-grayscale image to displaying a high-grayscale image.

Obviously, one skilled in the art may make various modifications and variations to the present disclosure without departing from the spirit and scope of the present disclosure. Therefore, if these modifications and variations to the present disclosure are included in the scope of the claims of the present disclosure and equivalent techniques thereof, the present disclosure also intends to include these modifications and variations.

What is claimed is:

1. A pixel circuit, comprising a driving transistor;

a light emission control module;

a first initialization module;

a second initialization module;

a threshold compensation module;

a data writing module;

a storage module; and a light emitting device;

wherein the light emission control module is configured to provide a signal of a first voltage terminal to a first terminal of the driving transistor under the control of a first light emission control terminal and to make a connection between a second terminal of the driving transistor and an anode of the light emitting device conductive under the control of a second light emission control terminal;

wherein the first initialization module is configured to reset a gate of the driving transistor;

wherein the second initialization module is configured to enable the signal of the first voltage terminal to flow through the driving transistor before the light emitting device emits light;

wherein the threshold compensation module is configured to compensate a threshold voltage of the driving transistor;

wherein the data writing module is configured to write a data signal of a data signal terminal into the gate of the driving transistor;

wherein the storage module is configured to keep a gate voltage of the driving transistor stable;

wherein the driving transistor is configured to generate a driving current according to the data signal to drive the light emitting device to emit light;

wherein the first initialization module is configured to provide a signal of a reference signal terminal to the gate of the driving transistor under the control of a first scanning signal terminal;

wherein the second initialization module is configured with the light emission control module and the first initialization module to enable the signal of the first voltage terminal to flow to the reference signal terminal after flowing through the driving transistor under the control of the first scanning signal terminal;

wherein the data writing module is configured to write the signal of the data signal; wherein the first initialization module comprises a third switching transistor;

wherein a gate of the third switching transistor is directly connected with the first scanning signal terminal, a first terminal of the third switching transistor is directly connected with the reference signal terminal and a second terminal of the third switching transistor is directly connected with the gate of the driving transistor; and wherein the second initialization module comprises a sixth switching transistor; wherein a gate of the sixth switching transistor is directly connected with the first scanning signal terminal, a first terminal of the sixth switching transistor is directly connected with the first terminal of the driving transistor and a second terminal of the sixth switching transistor is directly connected with the gate of the driving transistor.

2. The pixel circuit according to claim 1, wherein the pixel circuit further comprises an anode resetting module; and wherein the anode resetting module is configured to provide the signal of the reference signal terminal to the anode of the light emitting device under the control of the second scanning signal terminal.

3. The pixel circuit according to claim 1, wherein the light emission control module comprises a first switching transistor and a second switching transistor;

wherein a gate of the first switching transistor is connected with the first light emission control terminal, a first terminal of the first switching transistor is connected with the first voltage terminal and a second terminal of the first switching transistor is connected with the first terminal of the driving transistor; and wherein a gate of the second switching transistor is connected with the second light emission control terminal, a first terminal of the second switching transistor is connected with the second terminal of the driving transistor and a second terminal of the second switching transistor is connected with the anode of the light emitting device.

4. The pixel circuit according to claim 1, wherein the threshold compensation module comprises a fifth switching transistor; and wherein a gate of the fifth switching transistor is connected with the second scanning signal terminal, a first terminal of the fifth switching transistor is connected with the first terminal of the driving transistor and a second terminal of the fifth switching transistor is connected with the gate of the driving transistor.

5. The pixel circuit according to claim 1, wherein the data writing module comprises a fourth switching transistor; and wherein a gate of the fourth switching transistor is connected with the second scanning signal terminal, a first terminal of the fourth switching transistor is connected with the data signal terminal and a second terminal of the fourth switching transistor is connected with the first terminal of the driving transistor.

6. The pixel circuit according to claim 1, wherein the storage module comprises a capacitor; and wherein one terminal of the capacitor is connected with the first voltage terminal and the other terminal of the capacitor is connected with the gate of the driving transistor.

7. The pixel circuit according to claim 2, wherein the anode resetting module comprises a seventh switching transistor; and wherein a gate of the seventh switching transistor is connected with the second scanning signal terminal, a first terminal of the seventh switching transistor is connected with the reference signal terminal and a second terminal of the seventh switching transistor is connected with the anode of the light emitting device.

8. A display panel, comprising a pixel circuit as claim 1.

9. A display device, comprising a display panel, wherein the display panel comprises a pixel circuit, as claim 1.

10. A method for driving a pixel circuit as claim 1, wherein the method of driving the pixel circuit comprises:

at a first stage, providing a first potential signal to a first light emission control terminal and a first scanning signal terminal, and providing a second potential signal to a second light emission control terminal and a second scanning signal terminal; wherein the light emission control module provides the signal of a first voltage terminal to a first terminal of the driving transistor under the control of the first light emission control terminal, the first initialization module provides the signal of a reference signal terminal to a gate of the driving transistor under the control of the first scanning signal terminal, and the second initialization module cooperates with the light emission control module and the first initialization module to enable the signal of the first voltage terminal to flow to the reference signal terminal after flowing through the driving transistor under the control of the first scanning signal terminal;

at a second stage, providing a first potential signal to the first scanning signal terminal and providing a second potential signal to the first light emission control terminal, the second light emission control terminal and the second scanning signal terminal; wherein the first initialization module provides the signal of the reference signal terminal to the gate of the driving transistor under the control of the first scanning signal terminal;

at a third stage, providing a first potential signal to the second scanning signal terminal, and providing a second potential signal to the first light emission control terminal, the second light emission control terminal and the first scanning signal terminal; wherein the data writing module writes the signal of the data signal terminal into the first terminal of the driving transistor under the control of the second scanning signal, and the threshold compensation module makes the connection between the gate and a second terminal of the driving transistor conductive under the control of the second scanning signal terminal; and at a fourth stage, providing a first potential signal to the first light emission control terminal and the second light emission control terminal, and providing a second potential signal to the first scanning signal terminal and the second scanning signal terminal; wherein the light emission control module provides the signal of the first voltage terminal to the first terminal of the driving transistor under the control of the first light emission control terminal, and makes the connection between the second terminal of the driving transistor and an anode of the light emitting device conductive under the control of the second light emission control terminal; and wherein the driving transistor drives the light emitting device to emit light.

11. The method according to claim 10, the method further comprises:

at the first stage, providing a low-potential signal to the first light emission control terminal and the first scanning signal terminal, and providing a high-potential signal to the second light emission control terminal and the second scanning signal terminal; wherein the first switching transistor turns on to provide the signal of the first voltage terminal to the first terminal of the driving transistor, the third switching transistor turns on to provide the signal of the reference signal terminal to the gate of the driving transistor, and the sixth switching transistor turns on and cooperates with the turning-on first switching transistor and third switching transistor to enable the signal of the first voltage terminal to flow to the reference signal terminal after flowing through the driving transistor;

at the second stage, providing a low-potential signal to the first scanning signal terminal, and providing a high-potential signal to the first light emission control terminal, the second light emission control terminal and the second scanning signal terminal; wherein the third switching transistor turns on to provide the signal of the reference signal terminal to the gate of the driving transistor;

at the third stage, providing a low-potential signal to the second scanning signal terminal, and providing a high-potential signal to the first light emission control terminal, the second light emission control terminal and the first scanning signal terminal; wherein the fourth switching transistor turns on to write the signal of the data signal terminal into the first terminal of the driving transistor, and the fifth switching transistor turns on to make the connection between the gate and the second terminal of the driving transistor conductive; and at the fourth stage, providing a low-potential signal to the first light emission control terminal and the second light emission control terminal, and providing a high-potential signal to the first scanning signal terminal and the second scanning signal terminal; wherein the first switching transistor turns on to provide the signal of the first voltage terminal to the first terminal of the driving transistor, and the second switching transistor turns on to make the connection between the second terminal of the driving transistor and the anode of the light emitting device conductive; and wherein the driving transistor drives the light emitting device to emit light.

12. The method according to claim 10, the method comprises:

at the first stage, providing a high-potential signal to the first light emission control terminal and the first scanning signal terminal, and providing a low-potential signal to the second light emission control terminal and the second scanning signal terminal; wherein the first switching transistor turns on to provide the signal of the first voltage terminal to the first terminal of the driving transistor, the third switching transistor turns on to provide the signal of the reference signal terminal to the gate of the driving transistor, and the sixth switching transistor turns on and cooperates with the turning-on first switching transistor and third switching transistor to enable the signal of the first voltage terminal to flow to the reference signal terminal after flowing through the driving transistor;

at the second stage, providing a high-potential signal to the first scanning signal terminal, and providing a low-potential signal to the first light emission control terminal, the second light emission control terminal and the second scanning signal terminal; wherein the third switching transistor turns on to provide the signal of the reference signal terminal to the gate of the driving transistor;

at the third state, providing a high-potential signal to the second scanning signal terminal, and providing a low-potential signal to the first light emission control terminal, the second light emission control terminal and the first scanning signal terminal; wherein the fourth switching transistor turns on to write the signal of the data signal terminal into the first terminal of the driving transistor, and the fifth switching transistor turns on to make the gate and the second terminal of the driving transistor conductive; and at the fourth stage, providing a high-potential signal to the first light emission control terminal and the second light emission control terminal, and providing a low-potential signal to the first scanning signal terminal and the second scanning signal terminal; wherein the first switching transistor turns on to provide the signal of the first voltage terminal to the first terminal of the driving transistor, the second switching transistor turns on to make the second terminal of the driving transistor and the anode of the light emitting device conductive; and the driving transistor drives the light emitting device to emit light.

* * * * *